US006398176B1

(12) United States Patent
Liu

(10) Patent No.: US 6,398,176 B1
(45) Date of Patent: Jun. 4, 2002

(54) SUPPORTING ASSEMBLY FOR ARTICLES

(76) Inventor: Ching-Nan Liu, 2F., No. 165, Chienmin Rd., Pei Tou District, Taipei City (TW)

( * ) Notice: Subject to any disclaimer, the term of this patent is extended or adjusted under 35 U.S.C. 154(b) by 0 days.

(21) Appl. No.: 09/781,139

(22) Filed: Feb. 12, 2001

(51) Int. Cl.[7] ..... E04G 3/00

(52) U.S. Cl. ..... 248/284.1; 248/278.1; 248/918; 108/136; 108/146; 108/50.01

(58) Field of Search ..... 248/284.1, 918, 248/278.1, 276.1, 279.1, 280.11; 108/50.01, 136, 145, 146; 312/319.2

(56) References Cited

U.S. PATENT DOCUMENTS

| | | | | | |
|---|---|---|---|---|---|
| 5,881,984 | A | * | 3/1999 | Lin | 248/284.1 |
| 5,924,664 | A | * | 7/1999 | Mileos et al. | 248/281.11 |
| 5,924,666 | A | * | 7/1999 | Liu | 248/286.1 |
| 6,027,090 | A | * | 2/2000 | Liu | 248/281.11 |
| 6,186,460 | B1 | * | 2/2001 | Lin | 248/284.1 |
| 6,199,809 | B1 | * | 3/2001 | Hung | 248/284.1 |
| 6,257,538 | B1 | * | 7/2001 | Pangborn et al. | 248/284.1 |
| 6,296,215 | B1 | * | 10/2001 | McCoy et al. | 248/284.1 |
| 6,322,031 | B1 | * | 11/2001 | LeClair et al. | 248/286.1 |

* cited by examiner

*Primary Examiner*—Kimberly T. Wood
*Assistant Examiner*—Steven Marsh
(74) *Attorney, Agent, or Firm*—Charles E. Baxley

(57) ABSTRACT

A supporting assembly includes a mounting seat secured to an object, an inner connecting member having a first end pivotally connected to the mounting seat, an outer connecting member having a first end pivotally connected to the mounting seat by an axle, a wrist member pivotally connected to a second end of the inner connecting member and a second end of the outer connecting member, and a supporting plate pivotally connected to the second end of the outer connecting member and the wrist member. A spring is mounted around the axle and includes a first end attached to the mounting seat and a second end attached to the outer connecting member. A pressing portion of the inner connecting member presses against a stop of the inner connecting portion. When the supporting plate is moved upward, the wrist member, the outer connecting member, and the inner connecting member are pivoted such that the pressing portion of the inner connecting portion disengages from the stop of the mounting seat to thereby allow subsequent downward movement of the supporting plate to a desired level. When the supporting plate is released, the outer connecting member, the wrist member, and the supporting plate are supported under the action of the torsion spring, and the pressing portion of the inner connecting member is moved to press against the stop of the mounting seat to retain the supporting plate at the desired level.

4 Claims, 6 Drawing Sheets

SUPPORTING ASSEMBLY FOR ARTICLES

BACKGROUND OF THE INVENTION

1. Field of the Invention

The present invention relates to a supporting assembly that is adjustably attached to a desk for supporting articles, e.g., a computer keyboard, a typewriter, books, etc.

2. Description of the Related Art

An office desk generally has a drawer slidably attached to an underside thereof for supporting a computer keyboard, a typewriter, books, or other articles. Nevertheless, the user may feel uncomfortable or even be subject to occupational harm after a long-term use if the drawer is not located at a desired height. The present invention is intended to provide an improved supporting assembly to solve this problem.

SUMMARY OF THE INVENTION

It is a primary object of the present invention to provide an improved supporting assembly that can be adjustably attached to a desk for supporting articles thereon.

A supporting assembly in accordance with the present invention comprises:

a mounting seat adapted to be secured to an object and including a stop;

an inner connecting member including a first end and a second end, the first end of the inner connecting member being pivotally connected to the mounting seat, the inner connecting member further including a pressing portion;

an outer connecting member including a first end and a second end, the first end of the outer connecting member being pivotally connected to the mounting seat by an axle;

a wrist member pivotally connected to the second end of the inner connecting member and the second end of the outer connecting member; and a supporting plate pivotally connected to the second end of the outer connecting member and the wrist member;

a spring mounted around the axle and including a first end attached to the mounting seat and a second end attached to the outer connecting member;

wherein the pressing portion of the inner connecting member presses against the stop, and when the supporting plate is moved upward, the wrist member, the outer connecting member, and the inner connecting member are pivoted such that the pressing portion of the inner connecting portion disengages from the stop of the mounting seat to thereby allow subsequent downward movement of the supporting plate to a desired level; and wherein when the supporting plate is released, the outer connecting member, the wrist member, and the supporting plate are supported under the action of the torsion spring, the pressing portion of the inner connecting member is moved to press against the stop of the mounting seat to retain the supporting plate at the desired level.

In an embodiment of the invention, the inner connecting member includes a longitudinally extending slot and the mounting seat includes a pin that is guided in the longitudinally extending slot of the inner connecting member. A slide seat is secured to the object and a sliding plate is slidingly mounted to the slide seat. In addition, the mounting seat is secured to the sliding plate to slide therewith yet rotatable relative to the sliding plate, such that the mounting seat together with the sliding plate is slidable along the track, while the mounting seat is rotatable relative to the sliding plate.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
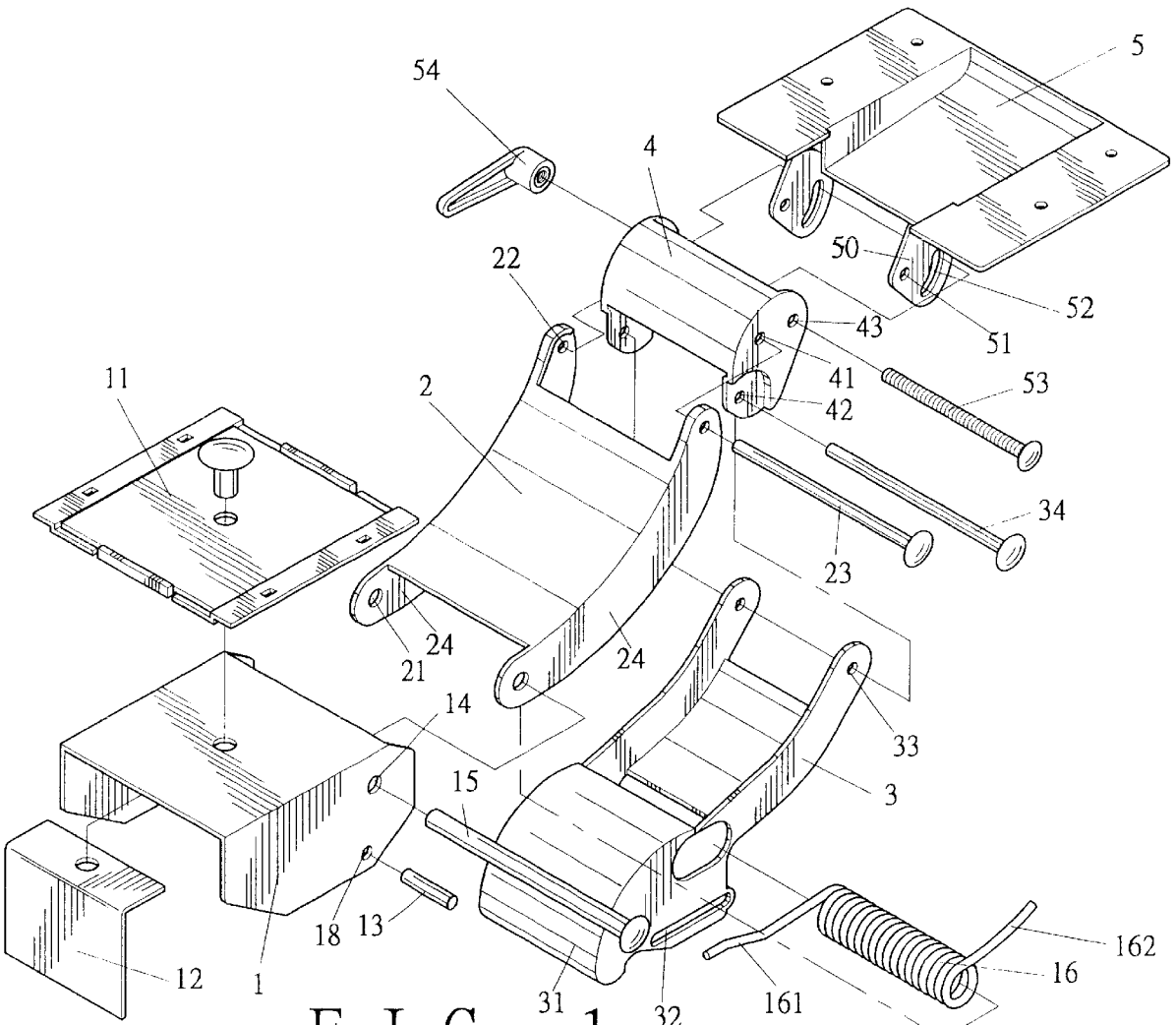
FIG. 1 is an exploded perspective view of a supporting assembly in accordance with the present invention.
Figure 2:
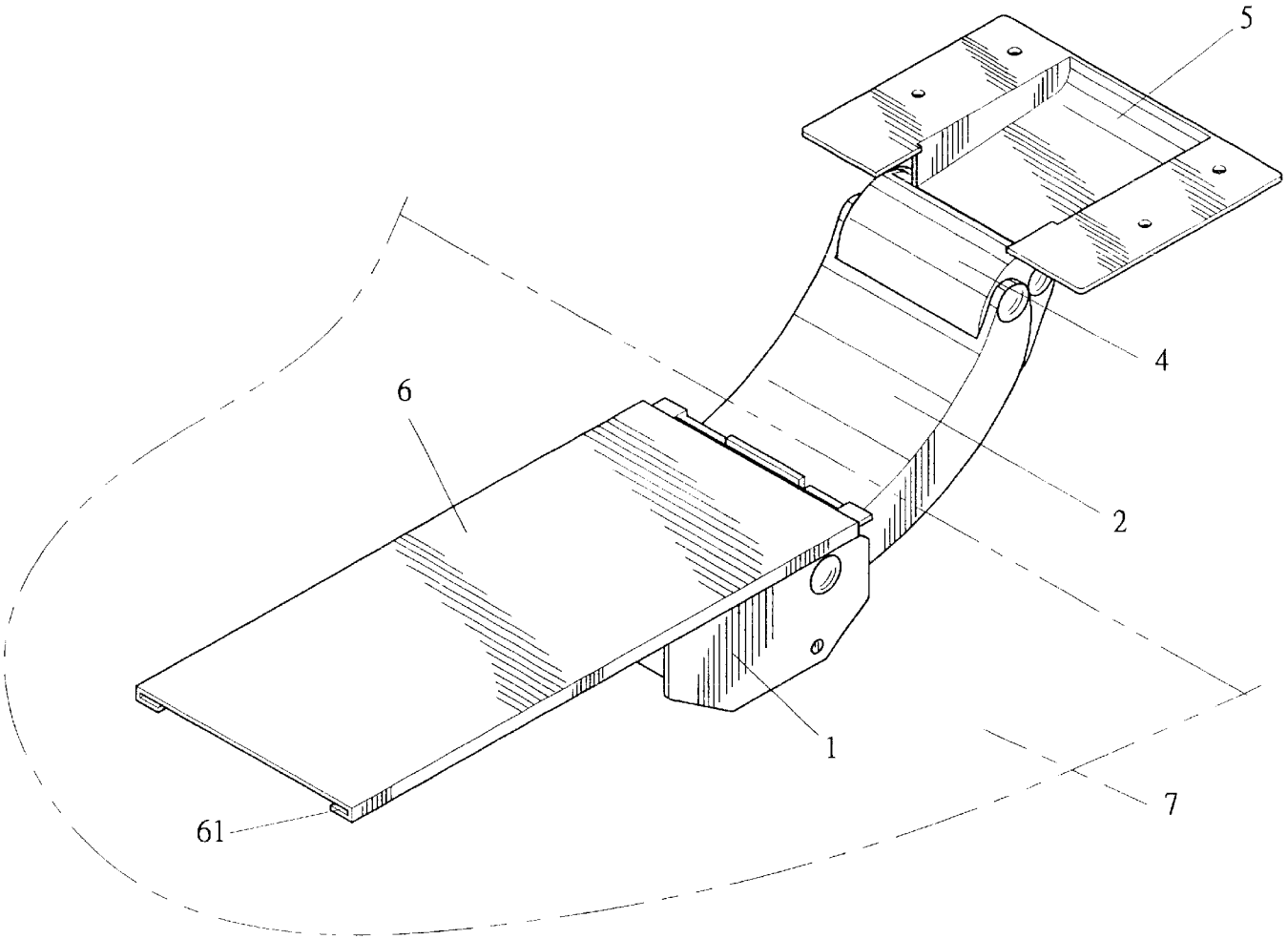
FIG. 2 is a perspective view of the supporting assembly.
Figure 3:
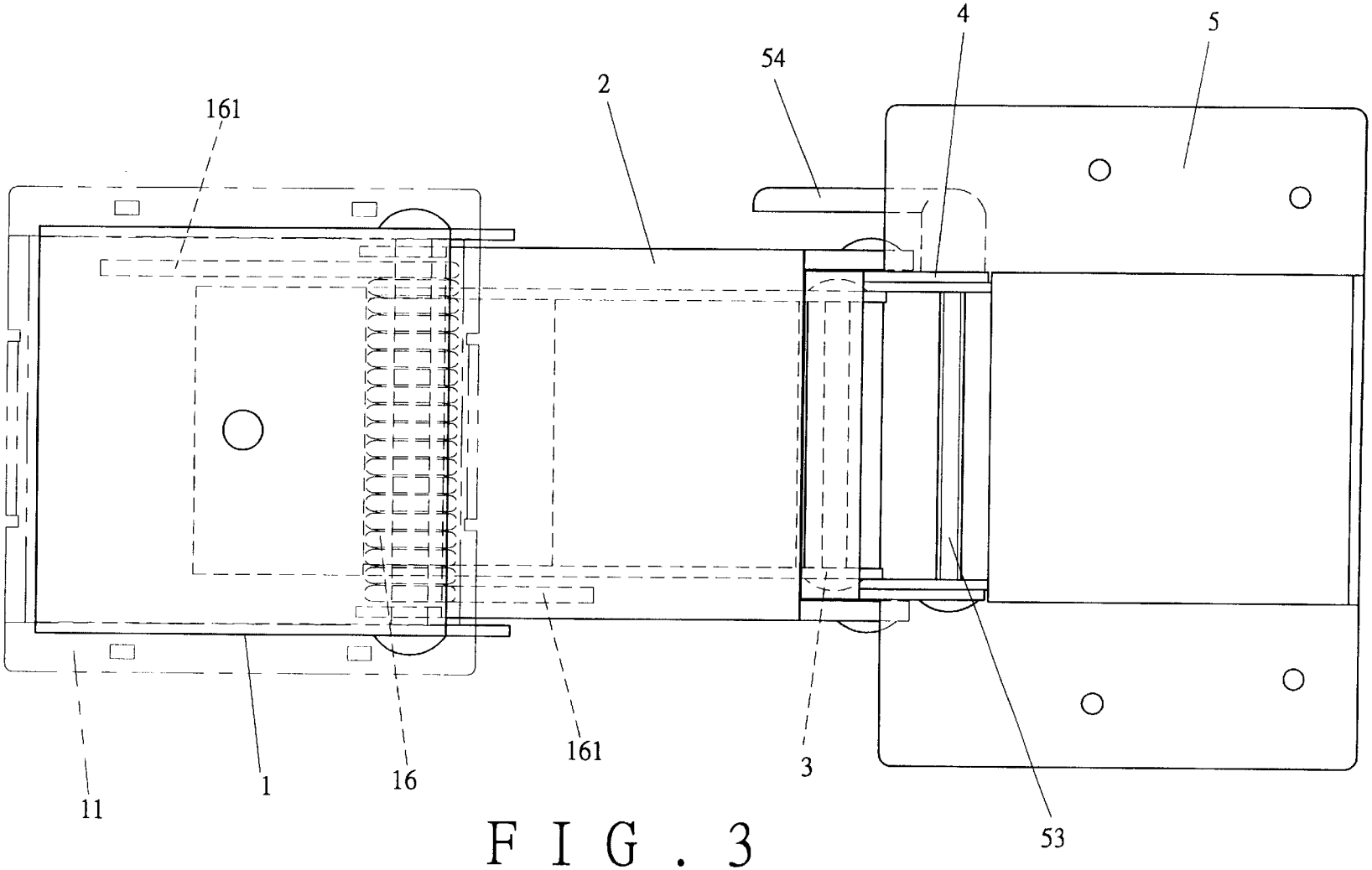
FIG. 3 is a top view of the supporting assembly.
Figure 4:
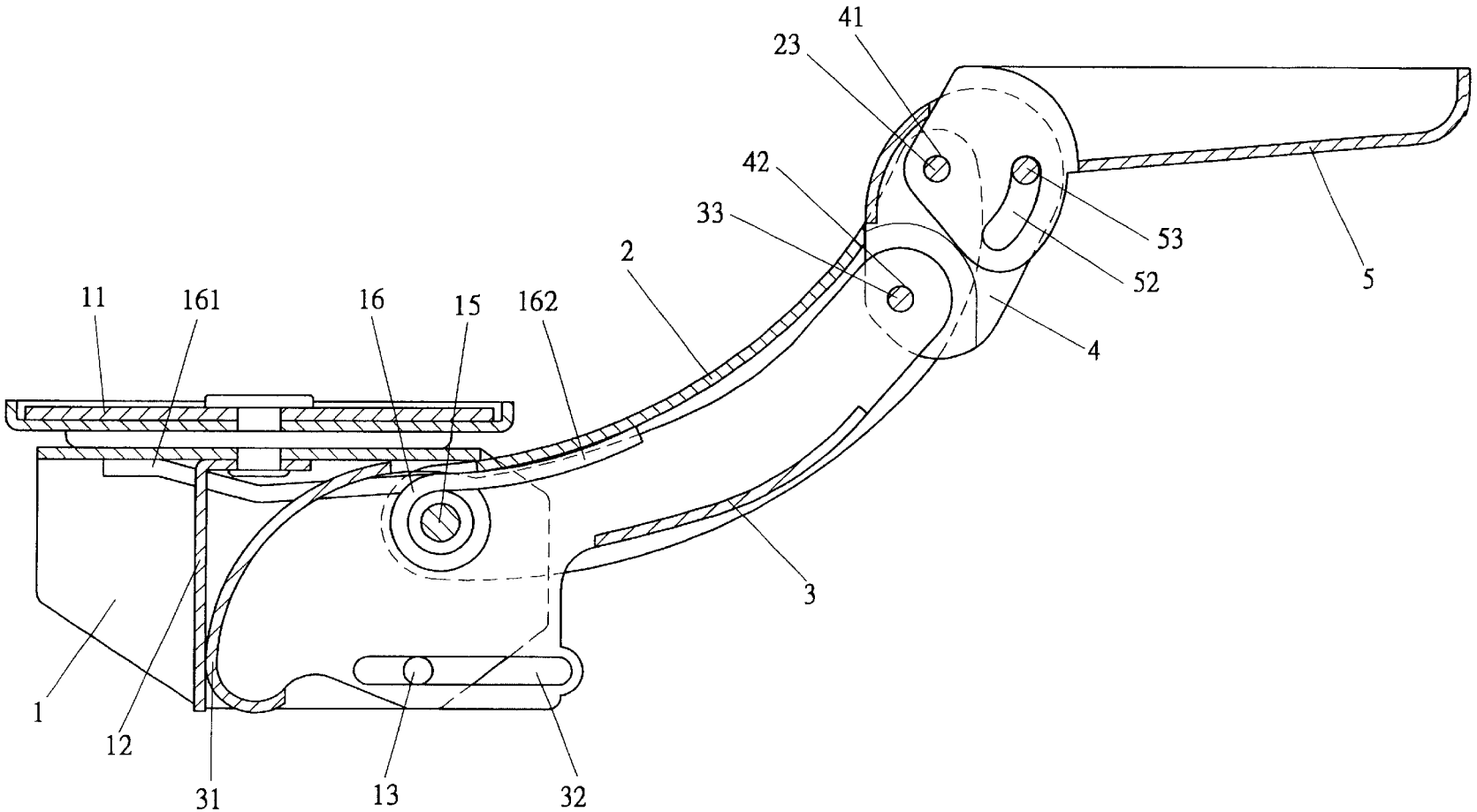
FIG. 4 is a sectional side view of the supporting assembly.

Referring to the drawings and initially to FIGS. 1 and 2, a supporting assembly in accordance with the present invention generally includes a mounting seat 1, an outer connecting member 2, an inner connecting member 3, a wrist member 4, and a supporting plate 5. The mounting seat 1 includes a sliding plate 11 pivotally connected to a top thereof and a stop 12 fixed thereto. The sliding plate 11 is slidingly received in a track 61 of a slide seat 6 (FIG. 2) that is fixed to an underside of an object, e.g., a desk 7. Thus, the mounting seat 1 together with the sliding plate 11 is slidable along the track 61, while the mounting seat 1 is rotatable relative to the sliding plate 11. The mounting seat 1 further includes two spaced side walls (not labeled) with aligned holes 14.

The outer connecting member 2 includes two lateral wings 24 having aligned holes 21 in first ends thereof and aligned holes 22 in second ends thereof. An axle 15 is extended through the holes 14 of the mounting seat 1 and the holes 21 of the outer connecting member 2, thereby pivotally connecting the inner connecting member 2 to the mounting seat 1. A torsion spring 16 is mounted around the axle 15 and includes a first end 161 attached to the mounting seat 1 and a second end 162 attached to the outer connecting member 2, which will be described later.

The inner connecting member 3 includes a first end and a second end in the form of two prongs (not labeled) with aligned holes 33. The first end of the inner connecting member 3 includes an arcuate pressing portion 31 and a slot 32 defined in one of two side walls thereof, the slot 32 extending along a direction substantially parallel to a longitudinal direction of the inner connecting member 3. A pin 13 is secured in a hole 18 in one of the side walls of the mounting seat 1 and extended through the slot 32 of the inner connecting member 3, which will be described later.

The wrist member 4 includes two side walls having aligned holes 41, 42, and 43. An axle 23 is extended through the holes 22 of the outer connecting member 2 and the holes 41 of the wrist member 4, thereby pivotally connecting the wrist member 4 and the outer connecting member 2 together. Another axle 34 is extended through the holes 34 of the inner connecting member 3 and the holes 42 of the wrist member 4, thereby pivotally connecting the wrist member 4 and the inner connecting member 3 together. It is noted that the side walls of the outer connecting member 2 are located outside the side walls of the inner connecting member 3.

The supporting plate 5 includes a top on which a computer keyboard, books, or other articles can be placed. Two parallel wings 50 extend downwardly from an underside thereof and include aligned holes 51 and aligned arcuate slot 52. The axle 23 that extends through the holes 22 of the outer connecting member 2 and the holes 41 of the wrist member 4 also extends through the aligned holes 51 of the supporting plate 5, thereby pivotally connecting the wrist member 4, the outer connecting member 2, and the supporting plate 5 together. A positioning screw 53 is extended through the aligned arcuate slots 52 of the wings 50 and a tightening lever 54 is engaged on an end of the positioning screw 53. When the lever 54 is in a first position, the positioning screw 53 is retained in the arcuate slots 52 and the supporting plate 5 is retained at a level and in an inclination angle relative to the wrist arm 4, and when the lever 54 is in a second position, the positioning screw 53 is slidable along the arcuate slots 52 and thus allows adjustment of the level and inclination angle of the supporting plate 5.

In assembly, as illustrated in FIGS. 1 through 4, the pin 13 of the mounting seat 1 is guided in the slot 32 of the inner connecting member 3 and the pressing portion 31 of the inner connecting member 3 presses against the stop 12. As illustrated in FIG. 2, the sliding plate 1 is slidingly received in the track 61 of the slide seat 6 during pivotal movement of the inner connecting member 3 relative to the mounting seat 1.

Figure 5:
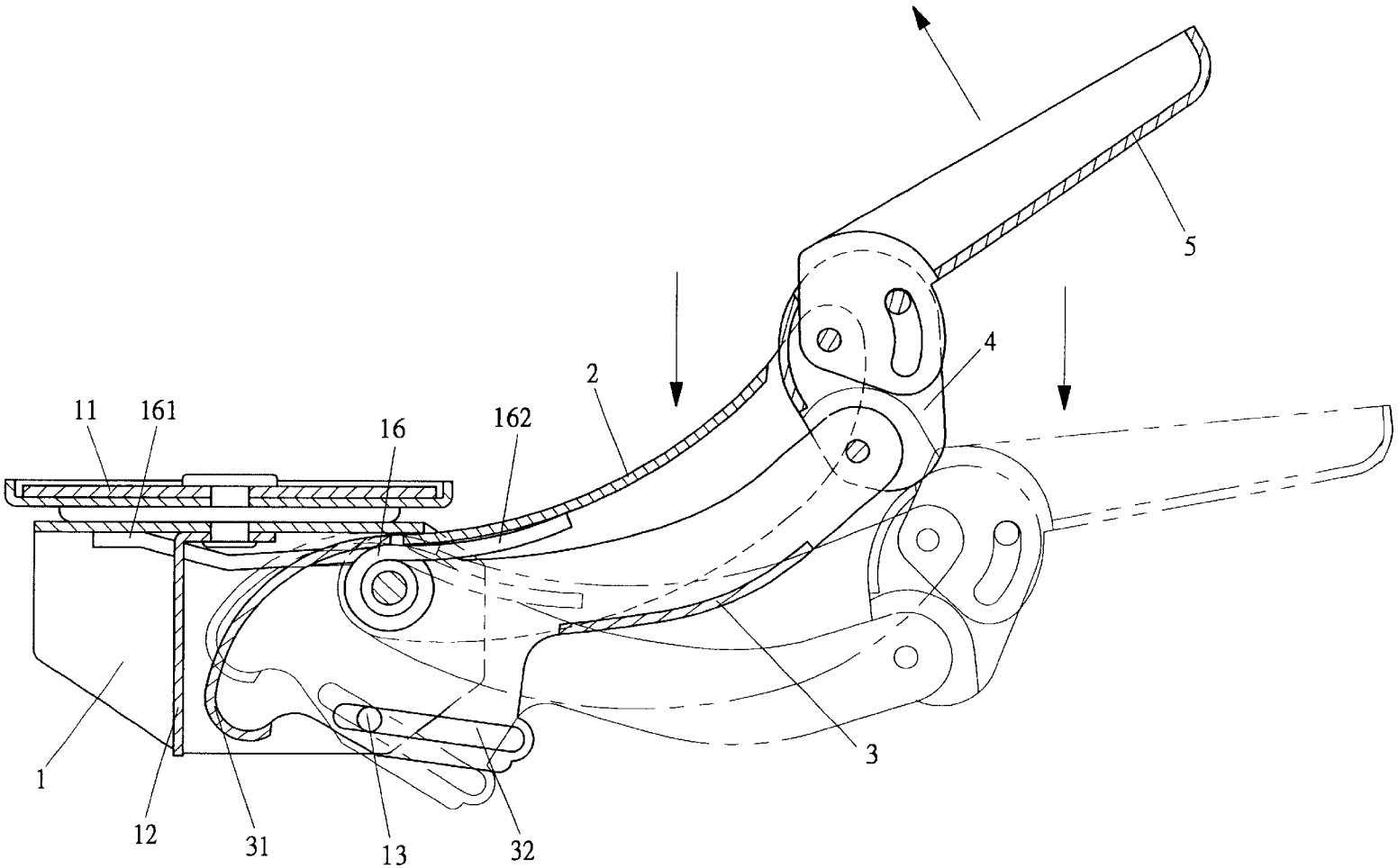
FIG. 5 is a sectional view similar to FIG. 4, illustrating adjustment of the supporting assembly.

As illustrated in FIG. 5, when the user moves the supporting plate 5 upward, the wrist member 4, the outer connecting member 2, and the inner connecting member 3 are pivoted. The pressing portion 31 of the inner connecting portion 3 disengages from the stop 12 of the mounting seat 1 such that the supporting plate 5 may be moved downward to a desired level.

Figure 6:
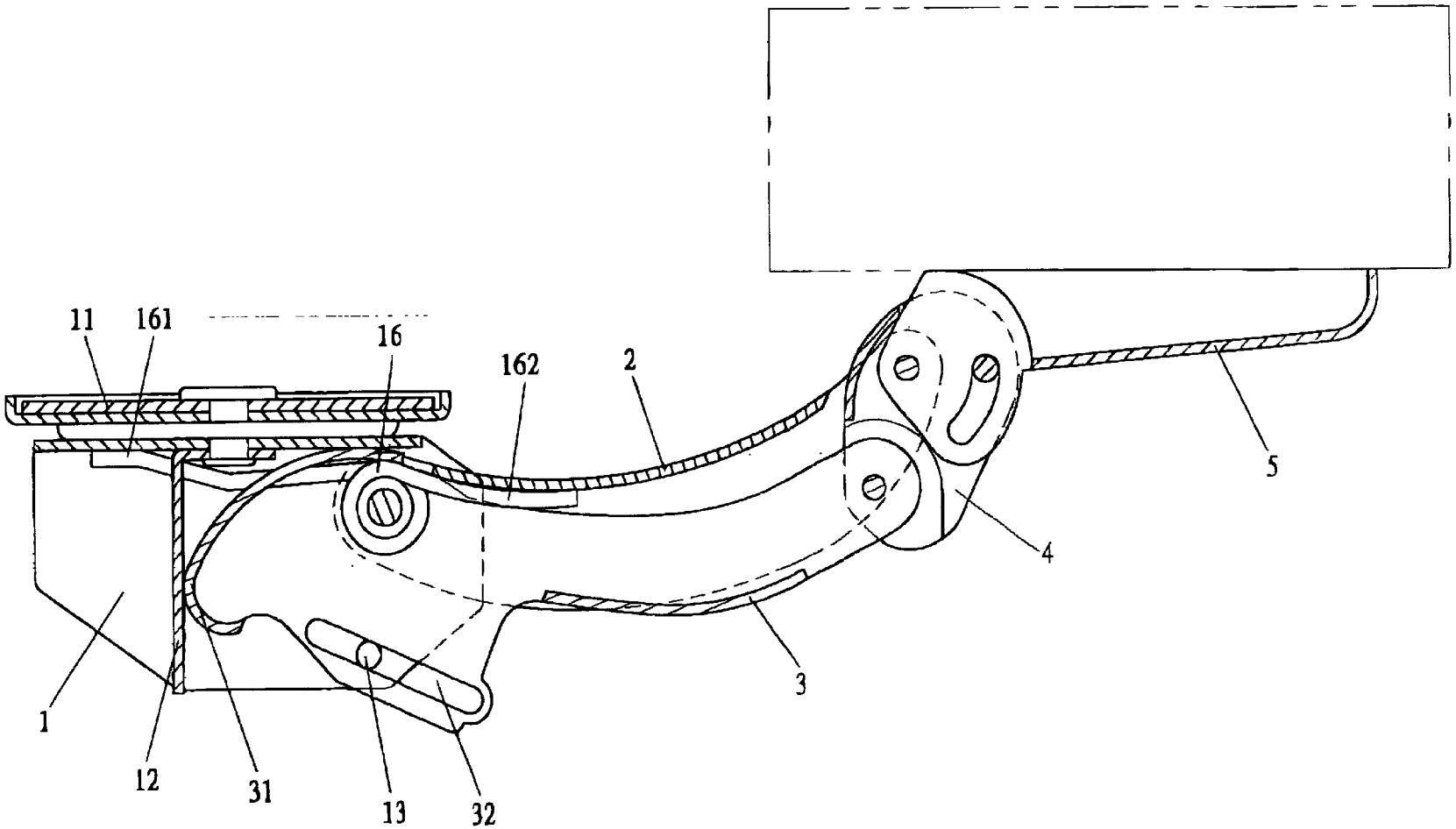
FIG. 6 is a sectional view similar to FIG. 5 illustrating use of the supporting assembly.

Referring to FIG. 6, when the supporting plate 5 is released, the outer connecting member 2, the wrist member 4, and the supporting plate 5 are supported under the action of the torsion spring 16. In addition, the pressing portion 31 of the inner connecting member 3 is moved to press against the stop 12 of the mounting seat 1 to retain the supporting plate 5 at a desired level. Thus, an article, such as a keyboard, flat plate, etc, can be placed on the supporting plate 5. The weight of the article further urges the pressing portion 31 of the inner connecting member 3 to press against the stop 12 of the mounting seat 1 to further assist in retaining the supporting plate 5 at a desired level. When the stop 12 is worn out, it can be replaced by a new one. This lengthens longevity of the supporting assembly in accordance with the present invention.

According to the above description, it is appreciated that the level of the supporting plate 5 can be easily adjusted and retained in place by means of provision of the pressing portion 31 of the inner connecting member 3 and the stop 12 of the mounting seat 1. In addition, longevity of the supporting assembly is lengthened.

Although the invention has been explained in relation to its preferred embodiment, it is to be understood that many other possible modifications and variations can be made without departing from the spirit and scope of the invention as hereinafter claimed.

What is claimed is:

1. A supporting assembly comprising:

a mounting seat adapted to be secured to an object and including a stop;

an inner connecting member including a first end and a second end, the first end of the inner connecting member being pivotally connected to the mounting seat, the inner connecting member further including a pressing portion;

an outer connecting member including a first end and a second end, the first end of the outer connecting member being pivotally connected to the mounting seat by an axle;

a wrist member pivotally connected to the second end of the inner connecting member and the second end of the outer connecting member; and a supporting plate pivotally connected to the second end of the outer connecting member and the wrist member;

a spring mounted around the axle and including a first end attached to the mounting seat and a second end attached to the outer connecting member;

wherein the pressing portion of the inner connecting member presses against the stop, and when the supporting plate is moved upward, the wrist member, the outer connecting member, and the inner connecting member are pivoted such that the pressing portion of the inner connecting portion disengages from the stop of the mounting seat to thereby allow subsequent downward movement of the supporting plate to a desired level; and wherein when the supporting plate is released, the outer connecting member, the wrist member, and the supporting plate are supported under the action of the torsion spring, the pressing portion of the inner connecting member is moved to press against the stop of the mounting seat to retain the supporting plate at the desired level.

2. The support assembly as claimed in claim 1, wherein the supporting plate includes two spaced wings having aligned arcuate holes, a positioning screw being extended through the arcuate holes, a tightening lever being engaged on an end of the positioning screw, when the lever is in a first position, the positioning screw is retained in the arcuate slots and the supporting plate is retained at a level and in an inclination angle relative to the wrist arm, and when the lever is in a second position, the positioning screw is slidable along the arcuate slots and thus allows adjustment of the level and the inclination angle of the supporting plate.

3. The support assembly as claimed in claim 1, wherein the inner connecting member includes a longitudinally extending slot and the mounting seat includes a pin that is guided in the longitudinally extending slot of the inner connecting member.

4. The support assembly as claimed in claim 1, further comprising a slide seat secured to the object, a sliding plate being slidingly mounted to the slide seat, wherein the mounting seat is secured to the sliding plate to slide therewith yet rotatable relative to the sliding plate, such that the mounting seat together with the sliding plate is slidable along the track, while the mounting seat is rotatable relative to the sliding plate.

* * * * *